US006877846B2

(12) United States Patent
Fellingham et al.

(10) Patent No.: US 6,877,846 B2
(45) Date of Patent: Apr. 12, 2005

(54) REPLACEABLE INK JET SUPPLY WITH ANTI-SIPHON BACK PRESSURE CONTROL

(75) Inventors: Peter J. Fellingham, San Diego, CA (US); Yichuan Pan, San Diego, CA (US); Mark M. Broschart, San Diego, CA (US); Dennis J. Astroth, Encinitas, CA (US)

(73) Assignee: Eastman Kodak Company, Rochester, NY (US)

( * ) Notice: Subject to any disclaimer, the term of this patent is extended or adjusted under 35 U.S.C. 154(b) by 66 days.

(21) Appl. No.: 10/138,883

(22) Filed: May 3, 2002

(65) Prior Publication Data

US 2003/0206219 A1 Nov. 6, 2003

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS

| | | | | | |
|---|---|---|---|---|---|
| 5,040,002 | A | * | 8/1991 | Pollacek et al. | 347/87 |
| 5,489,925 | A | * | 2/1996 | Brooks et al. | 347/6 |
| 5,555,007 | A | * | 9/1996 | Ceschin et al. | 347/87 |
| 5,691,753 | A | * | 11/1997 | Hilton | 347/85 |
| 5,751,300 | A | * | 5/1998 | Cowger et al. | 347/6 |
| 5,751,319 | A | * | 5/1998 | Robertson et al. | 347/85 |
| 5,854,646 | A | * | 12/1998 | Barinaga et al. | 347/85 |
| 5,880,748 | A | * | 3/1999 | Childers et al. | 347/6 |
| 6,030,074 | A | * | 2/2000 | Barinaga | 347/85 |
| 6,048,055 | A | * | 4/2000 | Hakkaku | 347/86 |
| 6,183,073 | B1 | * | 2/2001 | Rottman et al. | 347/85 |
| 6,196,669 | B1 | * | 3/2001 | Harvey et al. | 347/85 |
| 6,264,318 | B1 | | 7/2001 | Oda et al. | |
| 6,267,474 | B1 | * | 7/2001 | Mochizuki | 347/86 |
| 6,409,322 | B1 | * | 6/2002 | Ishitsu et al. | 347/85 |
| 6,428,157 | B1 | * | 8/2002 | Wen | 347/101 |
| 6,520,630 | B1 | * | 2/2003 | Oda et al. | 347/85 |

FOREIGN PATENT DOCUMENTS

| | | | | |
|---|---|---|---|---|
| DE | 34 29 073 A | | 2/1985 | |
| DE | 3640032 | * | 5/1988 | B41J/2/175 |
| JP | 05-096743 A | * | 4/1993 | B41J/2/175 |

* cited by examiner

*Primary Examiner*—Anh T. N. Vo
(74) *Attorney, Agent, or Firm*—Milton S. Sales; Mark G. Bocchetti

(57) ABSTRACT

A replaceable ink supply tank that can be mounted to a pen body of a printhead system for use with an ink jet printer. The ink supply tank provides the necessary back pressure for successful operation of the printhead and includes a siphon break in the conduit that supplies ink from the supply tank to the pen body. A conduit connects the ink supply tank to the pen body. The conduit contains a raised portion that is at a level higher than the ink level in the supply tank. The conduit contains a siphon break chamber between the raised portion and the pen body. The conduit further contains an accumulator in the raised portion of the supply tank. The accumulator maintains back pressure in the preferred range to discourage drooling from the nozzle plate during ambient temperature swings.

47 Claims, 8 Drawing Sheets

REPLACEABLE INK JET SUPPLY WITH ANTI-SIPHON BACK PRESSURE CONTROL

FIELD OF THE INVENTION

The present invention relates generally to ink jet printers, and more particularly to an ink jet cartridge with a replaceable ink tank.

BACKGROUND OF THE INVENTION

Different types of ink jet printers form their droplets of ink employing different methods. There are several technologies used by printer manufacturers, one of the most popular of which is the thermal ink jet. In a thermal ink jet printer, small resistors create heat which vaporizes ink to create a bubble adjacent to a print nozzle. The expansion that creates the bubble causes a droplet of ink to be ejected from the nozzle onto the media. Other technologies include piezo elements to generate pressure waves which cause drop ejection.

Ink jet type printers typically employ a printhead cartridge which is moved in a transverse fashion across a print media. Contemporary disposable ink jet printhead cartridges typically include a pen body with a self-contained ink reservoir, a printhead supporting a plurality of ink jet nozzles in combination with the ink reservoir, and a plurality of external electrical contacts for connecting the ink jet nozzles to driver circuitry. For a printer of this type there may be hundreds of these nozzles on the printhead. Printhead failure is usually due to failure of the resistors used to heat the ink in proximity to each nozzle. Due to relatively low resistor failure rates, the printhead used in the currently available disposable ink jet cartridges are fully operable to their original print quality specifications after the original ink reservoir has been depleted.

The disposal of these ink jet cartridges which are still able to perform adequately, except for the lack of ink in their supply containers, is wasteful. As a result, it is known in the art to manually replenish the ink reservoir within the disposable ink jet cartridge. However, manually refilling the disposable ink cartridges is often messy and difficult because many disposable ink jet cartridges are not designed with refilling in mind.

Furthermore, the back pressure at the printhead should be large enough to prevent the undesired free flow of ink through the nozzles when the printhead cartridge is at rest. The back pressure should also be small enough so that the printhead can overcome the back pressure and eject ink droplets in a consistent and predictable form when printing. What is needed is an improved printhead cartridge with a replaceable ink supply tank that is easy and clean to replace, yet maintains the appropriate back pressure desired for consistent printhead performance.

SUMMARY OF THE INVENTION

In one embodiment, the invention includes an improved printhead system having an ink supply tank containing a quantity of ink, a pen body having a printhead with a jet plate, and a conduit fluidly connecting the ink supply tank with the pen body. The conduit has a raised portion that carries the ink above a level of ink in the ink supply tank, and the conduit has a siphon break positioned between the raised portion and the jet plate.

In another embodiment, the invention is a printhead system having a pen body housing a first quantity of ink, wherein the pen body has a hollow needle and a printhead with a jet plate. The printhead system has an ink supply tank removably attached to the pen body, wherein the ink supply tank holds a second quantity of liquid ink in a foam-free reservoir, wherein the ink supply tank further has a vent for venting the ink supply tank, wherein the ink supply tank further has a septum configured to be pierced by the hollow needle. The printhead system also has a conduit fluidly connecting the ink supply tank with the pen body for replenishing the first quantity of ink from the second quantity of ink, wherein the conduit carries ink over a raised portion that rises to an elevation higher than a level of the second quantity of ink within the ink supply tank, wherein the conduit further has a siphon break region in a portion of the conduit between the raised portion the jet plate, the siphon break region has a chamber with a cross-sectional area and a height such that ink flow during printer operation does not span the entire cross-section and height of the chamber.

Another embodiment of the invention is a method of supplying ink from an ink supply tank to a printhead through a conduit. The method includes attaching a removable ink supply tank containing a quantity of ink to a pen body comprising a printhead, passing a supply of ink from the ink supply tank through a raised portion of the conduit, wherein the elevation of the raised portion is higher than a level of the ink in the ink supply tank, and passing the supply of ink through a siphon break in the conduit, wherein the siphon break is positioned between the raised portion and hump and the printhead.

Another embodiment of the invention is an ink supply tank containing a quantity of ink for use with an ink jet printhead system, wherein the supply tank is configured to be removably attached to a pen body of the ink jet printhead system, the ink supply tank comprising a conduit fluidly connecting the ink supply tank with the pen body, wherein the conduit is configured to carry the ink over a raised portion and through a siphon break chamber.

Another embodiment of the invention is a removable ink supply tank containing a quantity of ink for use with an ink jet printhead cartridge. The ink supply tank has an ink supply tube configured to carry ink over a raised portion that rises to an elevation higher than a level of the ink within the ink supply tank. The ink supply tank also has an accumulator connected to the ink supply tube, wherein the accumulator has a cross sectional area greater than a cross-sectional area of the ink supply tube. The ink supply tank also has an air vent that vents the ink supply tank to atmospheric pressure, wherein the air valve allows the passage of air but does not permit the passage of ink there through. The ink supply tank also has a siphon break chamber, wherein the siphon break chamber has a cross-sectional area and height such that ink flow during printing does not span the entire cross-section of the chamber, wherein the siphon break chamber has an orifice through which ink from the supply tube is received into the chamber, wherein the orifice comprises sidewalls that encourage ink flowing through the orifice to pass through in discrete drops, and wherein the chamber has a septum configured to be pierced by a needle. In one embodiment the siphon break chamber is cylindrical and has a diameter of at least 0.25 inches and a height of at least 0.25 inches.

BRIEF DESCRIPTION OF THE DRAWINGS

These and other objects and features of the invention will become more fully apparent from the following description and appended claims taken in conjunction with the following drawings, where like reference numbers indicate identical or functionally similar elements.

DETAILED DESCRIPTION OF THE INVENTION

Embodiments of the invention will now be described with reference to the accompanying figures, wherein like numerals refer to like elements throughout. The terminology used in the description presented herein is intended to be interpreted in its broadest reasonable manner in accordance with its ordinary use in the art and in accordance with any overt definitions provided below.

Figure 1:
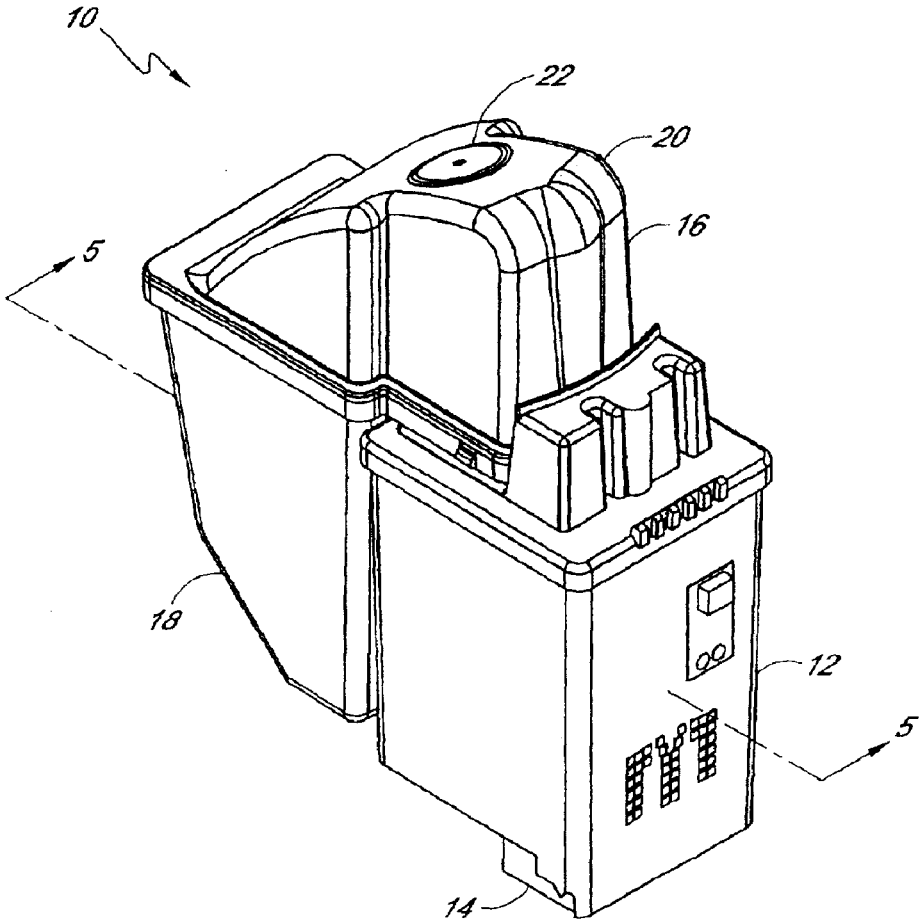
FIG. 1 is a perspective view of an embodiment of a printhead system according to one aspect of the invention.

FIG. 1 illustrates a printhead system 10 having a pen body 12 with a printhead 14 mounted thereon. The printhead system 10 can be removably inserted into a print carriage of a typical ink jet printer. Since the mechanisms and electronics within the printer may be conventional, the printer will not be further described in detail. The pen body 12 contains a volume of ink therein in fluid communication with the printhead 14. In one embodiment, the ink is received in a volume of foam contained within the pen body 12 as is known in the art. In FIG. 1, the pen body 12 is shown as mostly rectangular, although it will be recognized by those of skill in the art that the pen body 12 may take on any number of shapes to accommodate the desired volume of ink and/or the size of the printer housing, if the printhead system 10 is enclosed within such a housing.

The printhead system 10 further includes an ink supply tank 16. In one embodiment, the ink supply tank 16 is generally an inverted L-shaped container that includes a lower receptacle 18 that is positioned to the rear of the pen body 12 and an upper cap 20 that rests on top of the pen body 12. However, the ink supply tank 16 may take on any number of shapes to accommodate a preferred volume of ink and to conform to size of the printer housing. FIG. 1 illustrates the lower receptacle 18 and the upper cap 20 as separate molded portions of the ink supply tank 16, however, the ink supply tank 16 can be molded as a unitary piece and the lower receptacle 18 and upper cap 20 refer to portions of such unitary piece. The capacity of the ink supply tank 16 of one embodiment is about 50 ml.

A vent 22, preferably in the upper cap 20 of the ink supply tank 16, substantially equalizes the pressure inside the body of the ink supply tank 16 with atmospheric pressure. In one embodiment, the vent 22 is an air vent which permits the passage of air but prevents the passage of fluid. Other methods known to those skilled in the art can be used to vent the ink supply tank. It is preferable that ink is prevented from escaping through the vent 22 thereby preventing undesirable spilling of ink through the vent 22 during shipping or handling of the ink supply tank 16.

Figure 2:
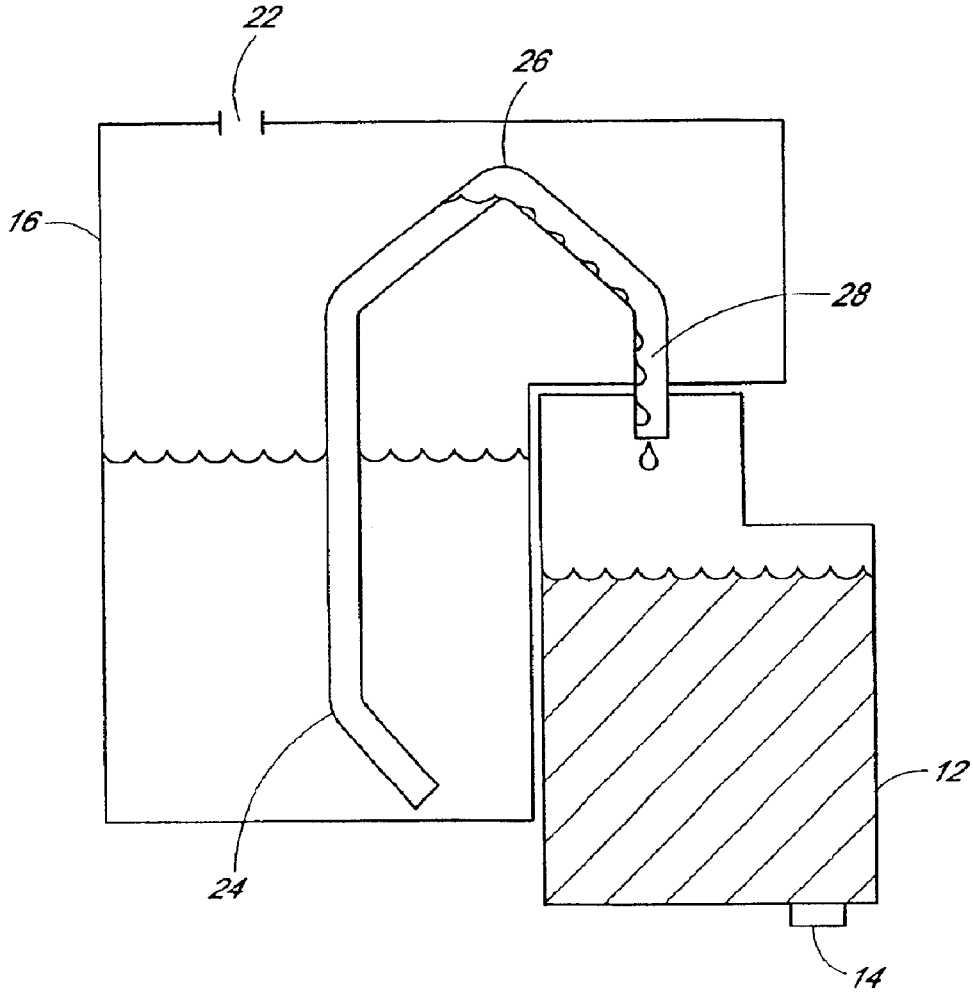
FIG. 2 is a schematic representation of the printhead system of FIG. 1.

Referring now to the schematic representation of an embodiment of the invention in FIG. 2, ink droplets are ejected from nozzles on the printhead 14 during printing operations. When the ink is expelled from the nozzles, ink from the pen body 12 is sucked into the printhead 14 by the vacuum force created when the ink is expelled. The depletion of ink in the pen body 12 creates a back pressure in the pen body 12. The back pressure in the pen body 12 pulls ink through a conduit 24 connecting the ink supply tank 16 to the pen body 12. It is desirable that at least a portion 26 of the conduit 24 rises above the ink level in the supply tank as will be discussed below. The back pressure in the pen body 12 will pull ink from the ink supply tank 16 up the conduit 24 and over the portion 26 which extends above the ink level.

As will be more fully discussed below, if a siphon break 28 in the conduit 24 between the portion 26 and the pen body 12 has a sufficient cross-sectional area such that ink flow does not span the entire cross-section of the siphon break 28, a siphon effect will not form. The remainder of the conduit 24 may have a cross-sectional area smaller than or equal to the cross-sectional area of the siphon break 28. However, if the cross-sectional area is equal, air bubbling through the ink in the conduit 24 may result when the ink level in the ink tank 16 is substantially used up. The siphon break 28 acts as part of the conduit 24 between the ink tank 16 and the pen body 12, but is preferably configured such that it is not substantially full of ink.

As ink flows from the ink supply tank 16 to the pen body 12, the back pressure in the pen body 12 subsides and the ink flow stops. It is desirable to maintain a slight negative pressure in the pen body 12 to prevent ink drool from the nozzles of the printhead 14. Acceptable negative pressure at the printhead 14 is preferably between −1 to −10 inches of water, more preferably between −2 to −6 inches of water, and most preferably between −2 to −4 inches of water. The optimum negative pressure is based on various factors, including the nozzle orifice architecture, the size of the supply tubing and properties of the foam in the pen body 12.

Figure 3:
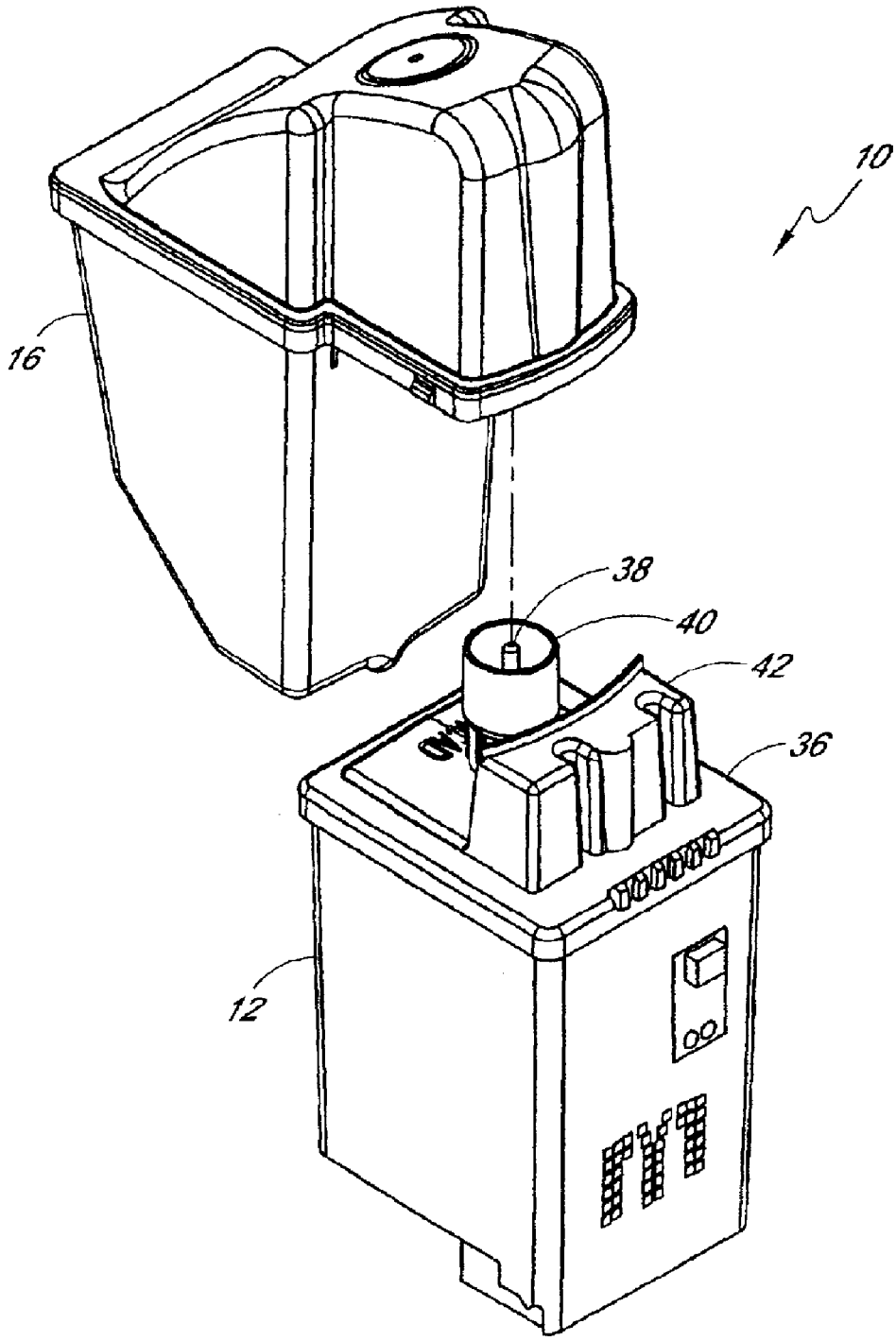
FIG. 3 is an exploded perspective view of the printhead system of FIG. 1 illustrating an ink supply tank and a pen body.

FIG. 3 is an exploded perspective view of the printhead system 10 of FIG. 1 illustrating that the ink supply tank 16 is detachable from the pen body 12. In one embodiment a lid 36 forms the top surface of the pen body 12. A hollow needle 38 extends through the lid 36 to provide a passage through which ink from the ink supply tank 16 flows into the pen body 12. Needle 38 may be 18-gage stainless steel having a diameter of about 1.2 mm, however, other needle sizes and materials may be used. A needle-guide fitting 40 surrounds the hollow needle 38. FIG. 3 illustrates the hollow needle 38 in a vertical orientation extending through the lid 36, however, one skilled in the art will understand that there are other possibilities for extending the needle from the pen body 12. For example, in one embodiment, the lid 36 contains a raised crown portion 42 and the needle 38 and needle guide fitting 40 can extend in a substantially horizontal configuration from the raised crown portion 42.

Figure 4:
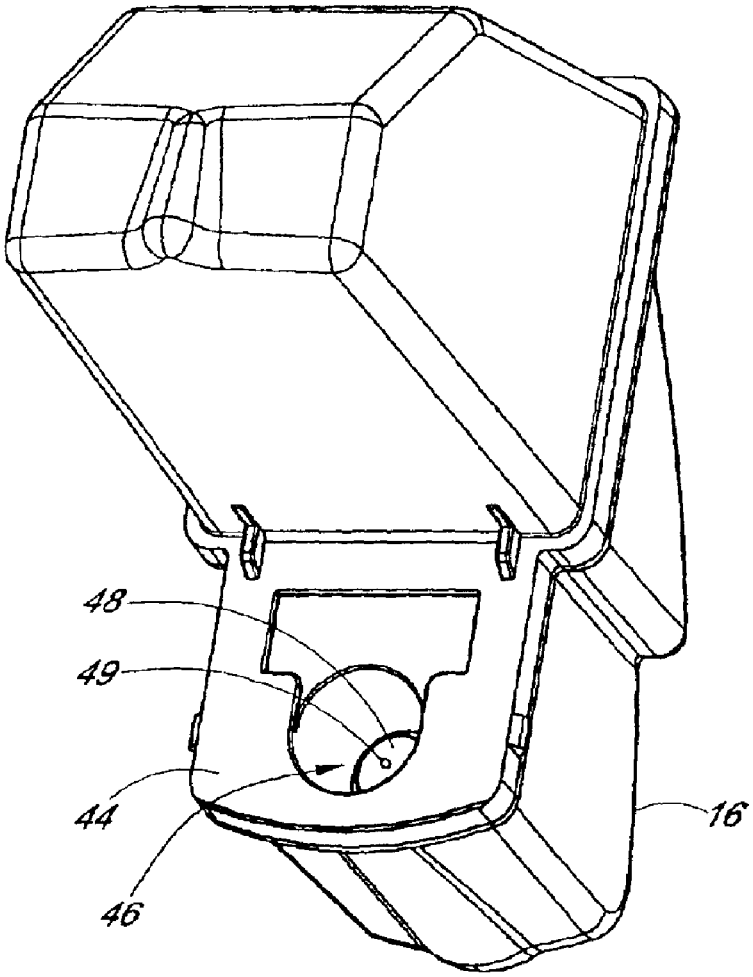
FIG. 4 is a perspective view of a lower surface of the ink supply tank of FIG. 3.

Referring now to FIG. 4, a bottom surface 44 of the ink supply tank 16 contains a recess 46 therein. The recess 46 is sized to receive the needle guide fitting 40 shown in FIG. 3. A pierceable barrier in the form of a septum 48 is disposed in the recess. Preferably, the septum 48 is made of rubber or another material having sufficient elasticity to reclose a self sealing perforation 49 located therein, such that the septum 48 provides a substantially fluid tight seal when the ink supply tank 16 is removed from the pen body 12 of FIG. 2.

Figure 5:
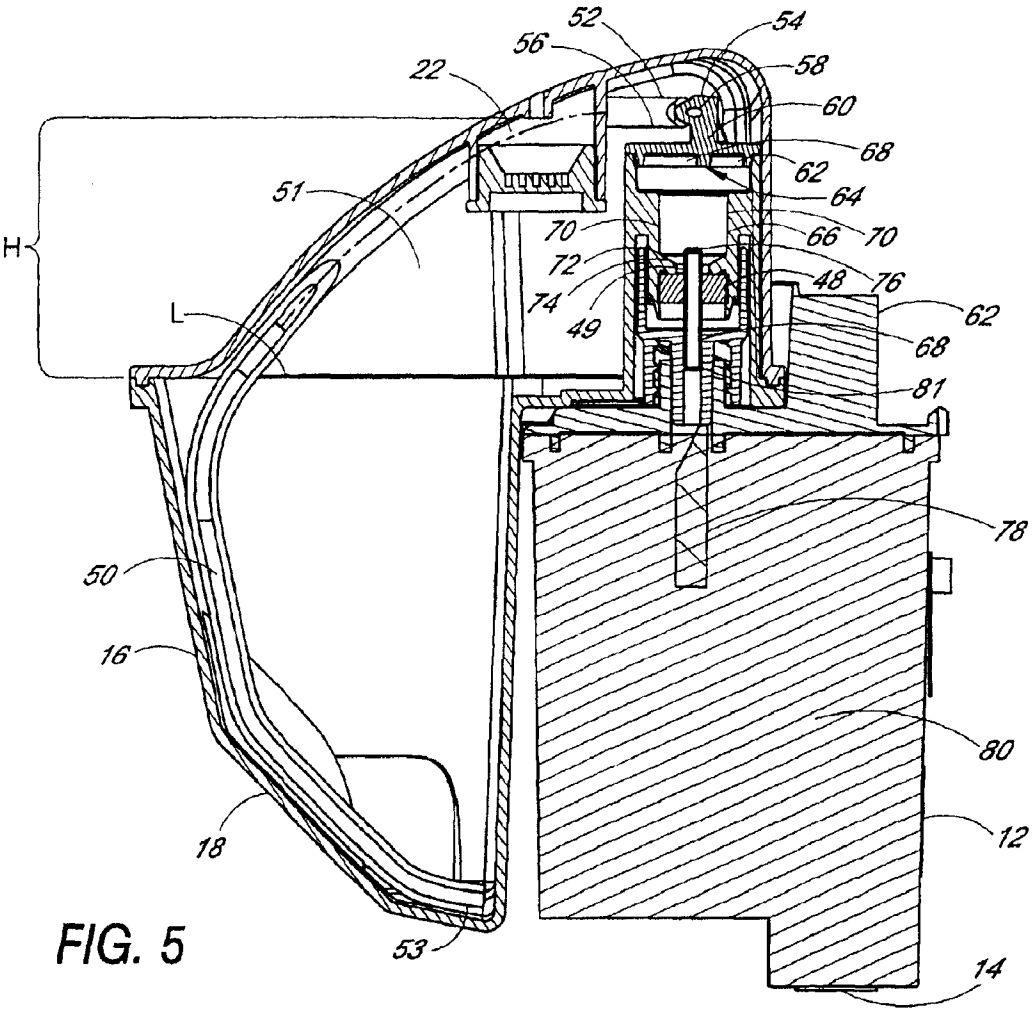
FIG. 5 is a cross sectional view of the printhead system of FIG. 1 taken along line 5—5 according to one embodiment of the invention.

FIG. 5 is a cross-sectional view of one embodiment of the ink supply tank 16. In one embodiment, the conduit 24 discussed in reference to FIG. 2 includes a hollow ink supply tube 50 that rises substantially the entire height of the ink supply tank 16. An air space 51, in which the vent 22 is located, is provided above the surface of the ink. Liquid ink at a level "L" fills the ink supply tank. In one embodiment, the ink supply tank is sized such that the ink level in the tank when the tank is full is approximately 2 inches higher than the ink level when all usable ink has been depleted. The ink supply tube 50 has a first end 53 positioned a lower portion of the ink supply tank 16 where it takes a suction from the tank. The supply tube 50 rises to a hump region 52 in the ink supply tank 16 a determined height "h" above the level of ink L in the ink supply tank. The height h is defined as the distance from the ink level L in the ink supply tank 16 to a lower inside surface 56 of the supply tube 50 in the hump region 52. As the ink supply tank 16 is vented to atmospheric pressure, the back pressure developed in the pen body 12 during printer operations is determined by the formula in Equation 1.

$$P_{Pen}=\rho hg \qquad \text{(Eq. 1)}$$

where:

$P_{Pen}$=Back pressure communicated to the pen $\rho$=density of ink h=height distance between ink level L and the inside surface of conduit g=gravity constant Thus, the back pressure in the pen body 12 is proportional to the head height between the ink level in the rising portion of the supply tube 50 and the ink level in the ink supply tank 16. As the head height of the liquid ink provides the necessary back pressure, the ink supply tank 16 does not need to be filled with foam.

In one embodiment, the hollow tube 50 fits over a fitting 54 in the hump region 52 of the ink supply tank 16. The fitting 54 can be molded as an integral part of the ink supply tank 16. The fitting 54 has a passage 58 therein that directs the ink flow from the hollow tube 50 to an ink plenum 60. A base wall 62 of the ink plenum 60 has an orifice 64 therein. The orifice 64 fluidly connects the ink plenum 60 with a drip chamber 66. The sidewalls 68 of the orifice 64 are preferably squared off so as to encourage the ink flowing through the orifice 64 to pass through and break off in discrete drops into the drip chamber 66. In one embodiment, the orifice has a diameter of 0.060 inches.

The drip chamber 66 has a width such that the capillary forces of the ink are insufficient to allow the drop of ink to stretch between opposite walls 70 of the drip chamber 66. Therefore, the ink passes through the orifice 64 in drops that fall directly to a floor 72 of the drip chamber 66. The drip chamber 66 thus forms a siphon break in the ink flow between the ink in reservoir 16 and the ink in the pen body 12. The floor 72 of the drip chamber 66 includes the septum 48 and a funnel portion 74 that collects the ink around an upper tip 76 of the hollow needle 38 protruding through the septum 48.

Preferably, the drip chamber 66 has a diameter of at least 0.25 inches, and more preferably, a diameter greater than 0.3 inches. The height of the drip chamber 66 is designed such that the drip chamber 66 has sufficient volume so that it will not completely fill with ink during printer operations. The static back pressure generated in the pen body 12 is proportional to the height of the drip chamber 66. The maximum height of the drip chamber 66 is designed to conform with the size of ink supply tank that will fit in the printer housing and the desired back pressure for the printhead 14. Preferably, the drip chamber 66 has a height of at least 0.25 inches. In one embodiment, the drip chamber 66 has a height of 0.345 inches. Other heights for the drip chamber 66 can be used accommodating for such factors as the density of the ink, available space in the printer housing and the like. Ink is dripped into the drip chamber 66 from the orifice 64 in response to the partial vacuum generated by the printhead 14 during printing. Preferably, the volume of ink dripped into the drip chamber 66 is equal to that consumed by the printhead 14, thus the drip chamber 66 remains substantially empty during printer operation.

As explained above, the hollow needle 38 extends through the perforation 49 in the septum 48 and into the drip chamber 66. The back pressure in the pen body 12 causes an ink drop to be sucked through the needle 38. In one embodiment, a Teflon stake 78 protruding from the lid 36 compresses foam 80 within the pen body 12 away from a lower tip 81 of the hollow needle 38. After the ink drop is sucked through the needle 38, it falls from the lower tip 81 of the needle 38 around the Teflon stake 78 and is wicked away by the foam 80. Preferably, the Teflon stake 78 separates the top of the foam 80 from contact with the lower tip 81 of the needle 38, thus breaking the fluid connection with the foam 80 to prevent continuous wicking of the ink into the foam 80, possibly resulting in drooling of ink from the nozzle plate of the printhead 14. Other embodiments of conducting the ink from the drip chamber 66 to the foam 80 in the pen body 12 can be conceived. For example, in the embodiment in which the hollow needle 38 extends from the raised crown portion 42 of the lid 36, ink can drip directly from the needle 38 onto the foam 80 in the pen body 12.

Figure 6:
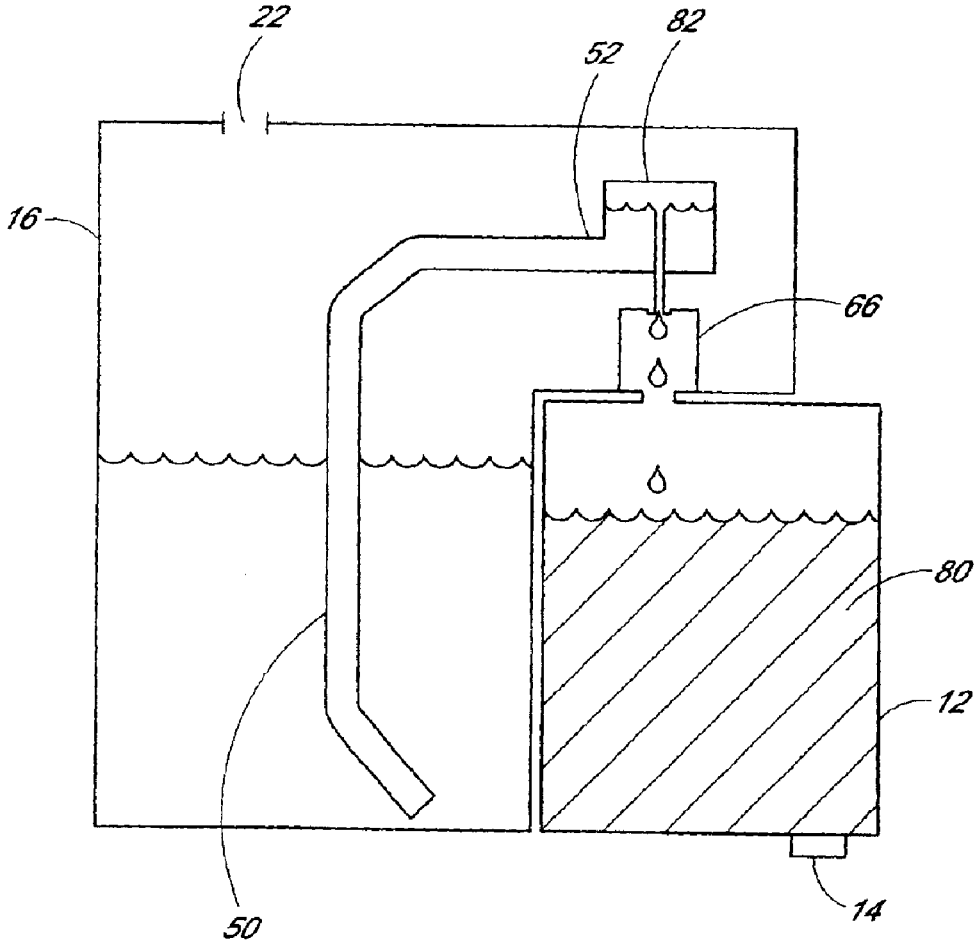
FIG. 6 is a schematic representation of the printhead system of FIG. 1 with an accumulator in the supply tube.
Figure 7:
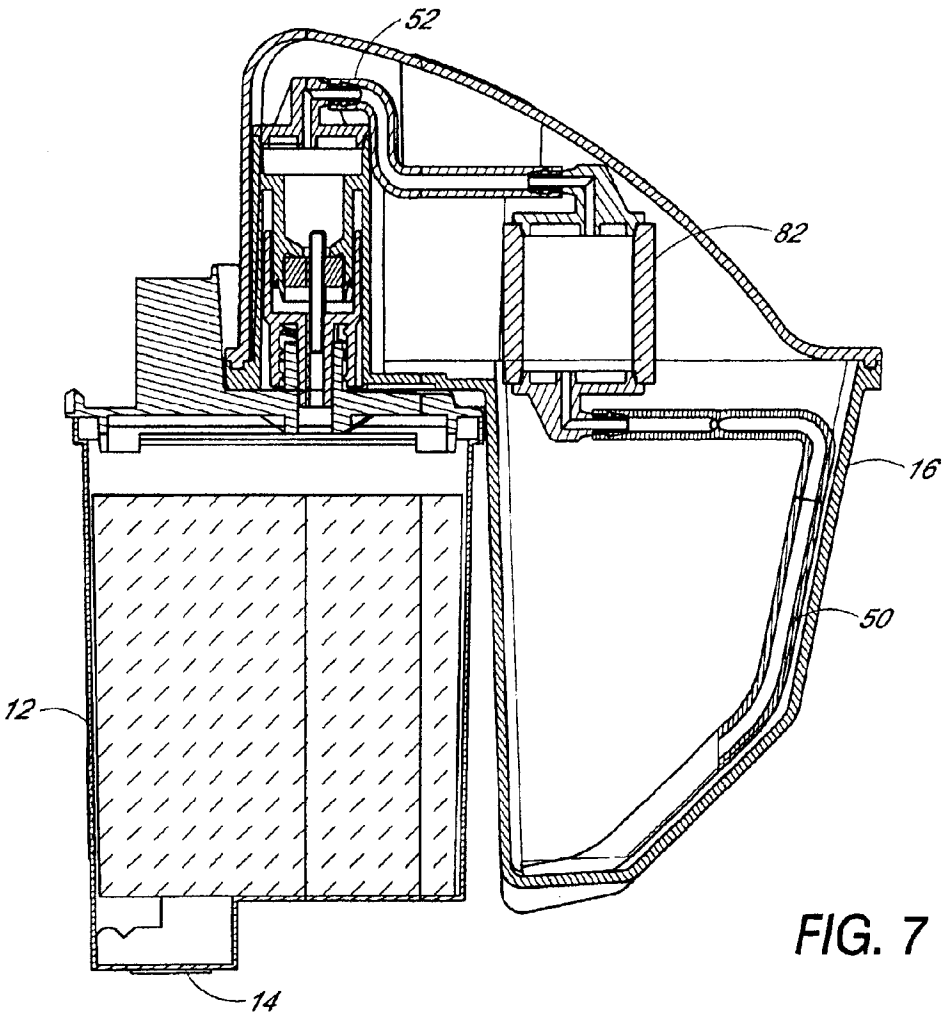
FIG. 7 is a cross sectional view of the printhead system of FIG. 1 taken along line 5—5 according to one embodiment of the invention illustrating the accumulator of FIG. 6.

FIG. 6 is a schematic representation of an embodiment of the invention in which an accumulator 82 is positioned between the supply tube 50 and the drip chamber 66. The accumulator 82 has an enlarged cross-section, such that it holds a small quantity of ink, for example between 1.5 and 2.5 ml, during printer operation. FIG. 7 is a cross-sectional view of an embodiment of the ink supply tank 16 illustrating the supply tube 50 and the accumulator 82 positioned near the hump region 52. The accumulator 82 aids in maintaining the back pressure communicated to the pen body during ambient temperature changes as will be explained using the following illustrative ambient temperature swing. As the ambient temperature increases, the air in the pen body expands as a result of the increasing temperature. The accumulator 82 serves as a surge vessel that receives the expanding air from the pen body 12. With the enlarged cross-sectional volume of the accumulator receiving the air, the ink level in the supply tube 50 does not drop substantially for a temperature increase of for example 10 degrees C. or more.

When ambient temperature decreases, for example by returning to the initial temperature, the air in the pen body 12 contracts to its previous volume. The air held in the accumulator 82 is then drawn back into the pen body 12 until the accumulator 82 is again full of ink.

If the temperature continues to drop, a proportionate volume of additional ink is drawn into the pen body 12. Then, as the temperature returns to the initial value, air is expelled once again from the pen body 12 into the accumulator 82. When printing resumes, there is a delay in the delivery of ink to the pen body 12 until all the air in the accumulator 82 has been drawn back into the pen body 12. The volume of ink held by the accumulator 82 determines the temperature change that can be accommodated before back pressure is affected and drooling from the printhead 14 occurs. The ink held in the accumulator 82 also represents unusable ink volume in some embodiments and thus the volume of the accumulator 82 can be scaled according to the usable ink in the ink tank 16 and the temperature swings that are desired to be tolerated.

Figure 8:
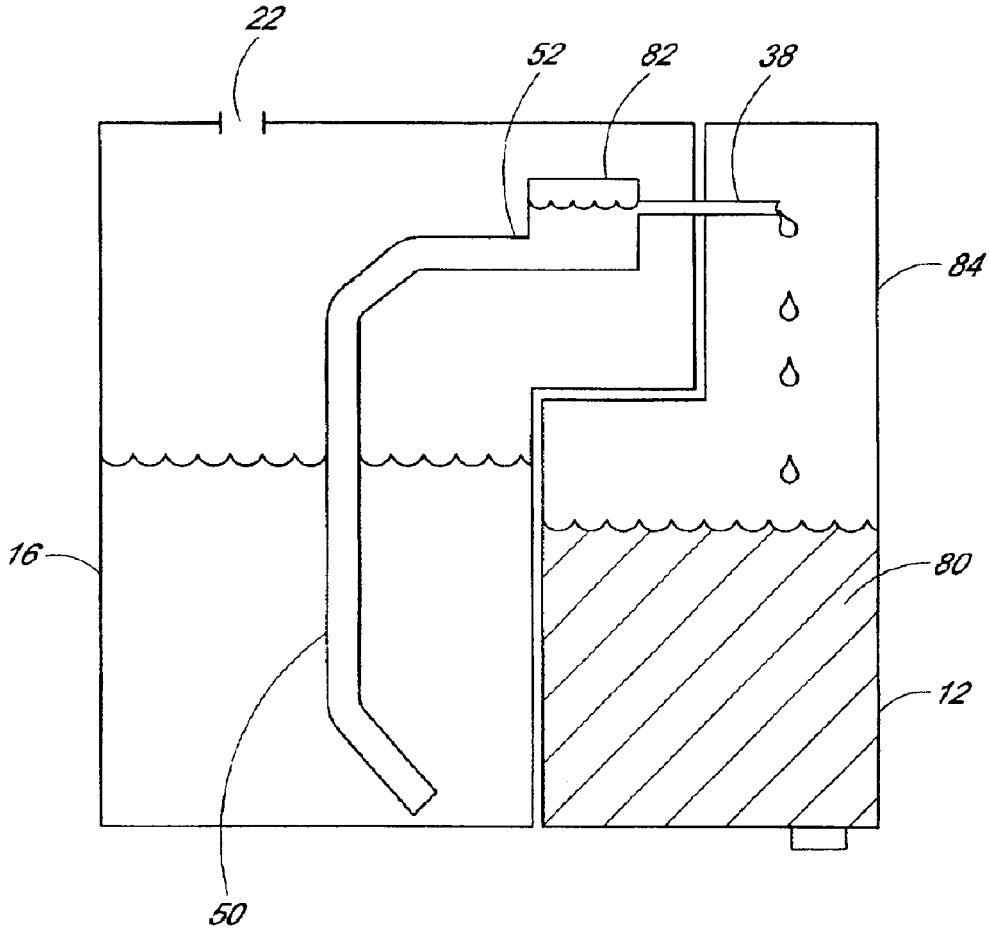
FIG. 8 is a schematic representation of the printhead system of FIG. 1 with the siphon break in the pen body.

FIG. 8 illustrates a schematic representation of the embodiment of the printhead system 10 in which the needle 38 and needle guide fitting 40 extend in a substantially horizontal configuration from the raised crown portion 42. In this configuration, the siphon break can be in the pen body 12 such that an air gap 84 above the foam 80 in the pen body 12 as the siphon break.

The invention provides a replaceable ink supply tank that can be mounted to a pen body. The ink supply tank provides the necessary back pressure for successful operation of the printhead system by including a siphon break in the conduit that supplies ink from the supply tank to the pen body. Other structures establishing a fluid connection between the ink supply tank and the pen body can be conceived by those skilled in the art without departing from the invention. For example, the ink plenum 60 and drip chamber 66 can be fabricated as part of the lid 36 of the pen body 12.

The invention was explained above with reference to a printhead system for use with a thermal ink jet writing system. However, the invention is not limited to use with thermal ink jet printhead writing systems, but may be used to replenish ink to cartridges feeding piezo printheads, or be configured to supply ink directly to thermal or piezo printheads without using intermediate foam cartridges. This invention may also be used in systems besides printing systems to deliver other fluids besides ink, such as medicinal or nutritive fluids.

The foregoing description details certain embodiments of the present invention and describes the best mode contemplated. Specific parts, shapes, materials, functions and modules have been set forth. However, a skilled technologist will realize that there are many ways to fabricate the system of one embodiment of the invention, and that there are many parts, components, modules or functions that may be substituted for those listed above. While the above detailed description has shown, described, and pointed out fundamental novel features of the invention as applied to various embodiments, it will be understood that various omissions and substitutions and changes in the form and details of the components illustrated may be made by those skilled in the art, without departing from the spirit or essential characteristics of the invention. The scope of the present invention should therefore be construed in accordance with the appended claims and any equivalents thereof.

What is claimed is:

1. A printhead system comprising:

an ink supply tank;

a pen body comprising a printhead with a jet plate; and a conduit fluidly connecting the ink supply tank with the pen body, wherein the conduit comprises a raised portion that carries the ink above a level of ink in the ink supply tank, and wherein the conduit comprises a siphon break.

2. The printhead system of claim 1, wherein the ink supply tank is detachably mounted to the pen body.

3. The printhead system of claim 1, wherein the ink supply tank contains a quantity of liquid ink in a foam-free receptacle.

4. The printhead system of claim 1, wherein the ink supply tank further comprises an air vent that vents the ink supply tank to atmospheric pressure.

5. The printhead system of claim 4, wherein the air vent allows the passage of air but does not permit the passage of ink there through.

6. The printhead system of claim 1, wherein the conduit comprises an ink supply tube and an accumulator, wherein said accumulator has a cross-sectional area larger than a cross-sectional area of the ink supply tube.

7. The printhead system of claim 1, wherein the conduit comprises an ink supply tube extending from near the bottom of the ink supply tank.

8. The printhead system of claim 1, wherein the ink supply tank further comprises a septum adapted to be pierced by a hollow needle in the pen body.

9. A printhead system comprising:

an ink supply tank;

a pen body comprising a printhead with a jet plate; and a conduit fluidly connecting the ink supply tank with the pen body, wherein the conduit comprises a raised portion that carries the ink above a level of ink in the ink supply tank, the conduit comprises a siphon break, and the siphon break comprises a chamber with a cross-sectional area and a height such that ink flow during a printing operation does not fill the entire cross-section and height of the chamber.

10. The printhead system of claim 9, wherein the chamber has a diameter of at least 0.25 inches.

11. The printhead system of claim 10, wherein the chamber has sufficient volume such that it does not completely fill with ink during the printer operation.

12. The printhead system of claim 11, wherein the chamber has a height of at least 0.25 inches.

13. The printhead system of claim 9, wherein the chamber receives ink through an orifice.

14. The printhead system of claim 13, wherein the orifice comprises squared off sidewalls that encourage ink flowing through the orifice to pass through as discrete drops.

15. A printhead system comprising:

an ink supply tank;

a pen body comprising a printhead with a jet plate; and a conduit fluidly connecting the ink supply tank with the pen body, wherein the conduit comprises a raised portion that carries the ink above a level of ink in the ink supply tank, the conduit comprises a siphon break, the ink supply tank further comprises a septum adapted to be pierced by a hollow needle in the pen body, and the pen body is at least partially filled with foam, and further comprising a stake for deforming the foam away from an end of the hollow needle protruding within the pen body, such that ink drops pass through the hollow needle and fall upon the stake.

16. A printhead system comprising:

a pen body housing a first quantity of ink, the pen body comprising a hollow needle and a printhead with a jet plate;

an ink supply tank removably attached to the pen body, wherein the ink supply tank holds a second quantity of liquid ink in a foam-free reservoir, wherein the ink supply tank further comprises a vent for venting the ink supply tank, wherein the ink supply tank further comprises a septum configured to be pierced by the hollow needle; and a conduit fluidly connecting the ink supply tank with the pen body for replenishing the first quantity of ink from the second quantity of ink, wherein the conduit carries ink over a raised portion that rises to an elevation higher than a level of the second quantity of ink within the ink supply tank, wherein the conduit further comprises a siphon break, a siphon break region comprising a chamber with a cross-sectional area and a height such that ink flow during a printer operation does not span the entire cross-section and height of the chamber.

17. The printhead system of claim 16, wherein the chamber has a diameter of at least 0.25 inches.

18. The printhead system of claim 16, wherein the chamber has sufficient volume such that it does not completely fill with ink during a printer operation.

19. The printhead system of claim 18, wherein the chamber has a height of at least 0.25 inches.

20. The printhead system of claim 16, wherein the chamber receives ink through an orifice.

21. The printhead system of claim 20, wherein the orifice comprises squared off sidewalls that encourage ink passing through the orifice to drip into the chamber as discrete drops.

22. The printhead system of claim 16, wherein the air vent allows the passage of air but does not permit the passage of ink there through.

23. The printhead system of claim 16, wherein the conduit further comprises an ink supply tube and an accumulator, wherein said accumulator has a cross-sectional area larger than a cross-sectional area of the ink supply tube.

24. A method of supplying ink from an ink supply tank to a printhead through a conduit, the method comprising:

attaching a removable ink supply tank containing a quantity of ink to a pen body comprising a printhead;

passing a supply of ink from the ink supply tank through a raised portion of the conduit, wherein the elevation of the raised portion is higher than a level of the ink in the ink supply tank; and breaking siphon action within the conduit.

25. The method of claim 24, further including venting the ink supply tank to atmospheric pressure.

26. A method, of supplying ink from an ink supply tank to a printhead through a conduit, the method comprising:

attaching a removable ink supply tank containing a quantity of ink to a pen body comprising a printhead;

passing a supply of ink from the ink supply tank through a raised portion of the conduit, wherein the elevation of the raised portion is higher than a level of the ink in the ink supply tank; and breaking siphon action within the conduit, wherein breaking siphon action comprises passing the supply of ink through a chamber with a cross-sectional area with sufficient diameter such that ink flow during a printing operation does not span the entire cross-section of the chamber.

27. The method of claim 26, breaking siphon action comprises passing the supply of ink through a cylindrical chamber having a diameter of at least 0.25 inches and a height of at least 0.25 inches.

28. An ink supply tank containing a quantity of ink for use with an ink jet printhead cartridge, wherein the supply tank is configured to be removably attached to a pen body of an ink jet printhead system, the ink supply tank comprising a conduit fluidly connecting the ink supply tank with the pen body, wherein the conduit is configured to carry the ink over a raised portion and through a siphon break.

29. The supply tank of claim 28, further comprising an air vent that vents the ink supply tank to atmospheric pressure.

30. The ink supply tank of claim 29, wherein the air vent allows the passage of air but does not permit the passage of ink there through.

31. The ink supply tank of claim 28, wherein the conduit carries the ink over a raised portion that rises to an elevation higher than a level of the ink within the ink supply tank.

32. The ink supply tank of claim 28, wherein the conduit comprises an ink supply tube that extends from near the bottom of the ink supply tank.

33. The ink supply tank of claim 28, further comprising a septum configured to be pierced by a needle on the pen body.

34. An ink supply tank containing a quantity of ink for use with an ink jet printhead cartridge, wherein the supply tank is configured to be removably attached to a pen body of an ink jet printhead system, the ink supply tank comprising a conduit fluidly connecting the ink supply tank with the pen body, wherein the conduit is configured to carry the ink over a raised portion and through a siphon break, wherein the siphon break comprises a chamber with a cross-sectional area such that ink flow during a printing operation does not span the entire cross-section of the chamber.

35. The ink supply tank of claim 34, wherein the siphon break chamber is cylindrical and has a diameter of at least 0.25 inches.

36. The ink supply tank of claim 34, wherein the siphon break chamber has sufficient volume such that it does not completely fill with ink during the printer operation.

37. The ink supply tank of claim 36, wherein the siphon break chamber has a height of at least 0.25 inches.

38. The ink supply tank of claim 34, wherein the siphon break chamber receives ink through an orifice.

39. The ink supply tank of claim 38, wherein the orifice comprises squared off sidewalls that encourage ink flowing through the orifice to pass through in discrete drops.

40. An ink supply tank containing a quantity of ink for use with an ink jet printhead cartridge, wherein the supply tank is configured to be removably attached to a pen body of an ink jet printhead system, the ink supply tank comprising a conduit fluidly connecting the ink supply tank with the pen body, wherein the conduit is configured to carry the ink over a raised portion and through a siphon break, wherein the conduit further comprises an ink supply tube and an accumulator, wherein said accumulator has a cross-sectional area larger than a cross-sectional area of the ink supply tube.

41. A printhead system comprising:

an ink supply tank containing a quantity of ink;

a pen body;

means for transferring ink from the ink supply tank to the pen body, wherein said means for transferring ink raises the fluid being transferred to an elevation above a level of ink in the ink supply tank; and means for breaking siphon action between the means for transferring ink and the pen body.

42. A removable ink supply tank containing a quantity of ink for use with an ink jet printhead cartridge, the ink supply tank comprising:

an ink supply tube configured to carry ink over a raised portion that rises to an elevation higher than a level of the ink within the ink supply tank;

an accumulator connected to the ink supply tube, wherein the accumulator has a cross sectional area greater than a cross-sectional area of the ink supply tube;

an air vent that vents the ink supply tank to atmospheric pressure, wherein the air vent allows the passage of air but does not permit the passage of ink there through; and a siphon break chamber, wherein the siphon break chamber has a cross-sectional area and height such that ink flow during a printing operation does not span the entire cross-section of the chamber, wherein the siphon break chamber has an orifice through which ink from the supply tube is received into the chamber, wherein the orifice comprises sidewalls that encourage ink flowing through the orifice to pass through in discrete drops, and wherein the chamber has a septum configured to be pierced by a needle.

43. A removable ink supply tank containing a quantity of ink for use with an ink jet printhead cartridge, the ink supply tank comprising:

an ink supply tube configured to carry ink over a raised portion that rises to an elevation higher than a level of the ink within the ink supply tank;

an accumulator connected to the ink supply tube, wherein the accumulator has a cross sectional area greater than a cross-sectional area of the ink supply tube;

an air vent that vents the ink supply tank to atmospheric pressure, wherein the air vent allows the passage of air but does not permit the passage of ink there through; and a siphon break chamber, wherein the siphon break chamber has a cross-sectional area and height such that ink flow during printing does not span the entire cross-section of the chamber, wherein the siphon break chamber has an orifice through which ink from the supply tube is received into the chamber, wherein the orifice comprises sidewalls that encourage ink flowing through the orifice to pass through in discrete drops, and wherein the chamber has a septum configured to be pierced by a needle, wherein the siphon break chamber is cylindrical and has a diameter of at least 0.25 inches.

44. The ink supply tank of claim 43, wherein the siphon break chamber has a height of at least 0.25 inches.

45. The ink supply tank of claim 43, wherein the siphon break chamber has sufficient volume such that it does not completely fill with ink during the printer operation.

46. A removable ink supply tank containing a quantity of ink for use with an ink jet printhead cartridge, the ink supply tank comprising:

an ink supply tube configured to carry ink over a raised portion that rises to an elevation higher than a level of the ink within the ink supply tank;

an accumulator connected to the ink supply tube, wherein the accumulator has a cross sectional area greater than a cross-sectional area of the ink supply tube;

an air vent that vents the ink supply tank to atmospheric pressure, wherein the air vent allows the passage of air but does not permit the passage of ink there through; and a siphon break chamber, wherein the siphon break chamber has a cross-sectional area and height such that ink flow during printing does not span the entire cross-section of the chamber, wherein the siphon break chamber has an orifice through which ink from the supply tube is received into the chamber, wherein the orifice comprises sidewalls that encourage ink flowing through the orifice to pass through in discrete drops, and wherein the chamber has a septum configured to be pierced by a needle, wherein the ink supply tank does not contain foam.

47. A printhead system comprising:

an ink supply tank;

a pen body comprising a printhead with a jet plate; and a conduit fluidly connecting the ink supply tank with the pen body, wherein ink in the ink supply tank is higher than the jet plate, and wherein the conduit comprises a siphon break.

* * * * *